US005890462A

United States Patent [19]

Bassett

[11] Patent Number: 5,890,462

[45] Date of Patent: Apr. 6, 1999

[54] TANGENTIAL DRIVEN ROTARY ENGINE

[76] Inventor: Wladimir A Bassett, P.O. Box 2036, Managua, Nicaragua

[21] Appl. No.: 867,560

[22] Filed: Jun. 2, 1997

[51] Int. Cl.[6] ..... F02B 75/06

[52] U.S. Cl. ..... 123/56.2; 123/56.7

[58] Field of Search ..... 123/56.1, 56.2, 123/56.7

[56] References Cited

U.S. PATENT DOCUMENTS

| | | | |
|---|---|---|---|
| 1,177,609 | 4/1916 | Edwards | 123/56.7 |
| 1,181,463 | 5/1916 | Fontaine | 123/56.7 |
| 1,838,974 | 12/1931 | Williams | 123/56.2 |
| 1,945,727 | 2/1934 | Braunwalder | 123/56.1 |
| 2,274,097 | 2/1942 | Sheerer | 123/56.7 |
| 2,301,175 | 11/1942 | Earnshaw et al. | 123/56.7 |
| 2,353,313 | 7/1944 | Lane | 123/56.7 |
| 3,319,874 | 5/1967 | Welsh et al. | 123/56.4 |
| 3,673,991 | 7/1972 | Winn | 123/56.7 |
| 3,895,614 | 7/1975 | Bailey | 123/56.7 |
| 3,945,359 | 3/1976 | Asaga | 123/56.1 |
| 4,084,555 | 4/1978 | Outlaw | 123/56.7 |
| 4,553,508 | 11/1985 | Stinebaugh | 123/56.7 |
| 5,113,809 | 5/1992 | Ellenburg | 123/56.4 |
| 5,749,337 | 5/1998 | Palatov | 123/56.2 |

FOREIGN PATENT DOCUMENTS

| | | | |
|---|---|---|---|
| 3408447 | 9/1985 | Germany | 123/56.2 |
| 493512 | 4/1954 | Italy | 123/56.2 |
| 96946 | 9/1939 | Sweden | 123/56.2 |
| 253524 | 11/1926 | United Kingdom | 123/56.2 |
| 373879 | 6/1932 | United Kingdom | 123/56.2 |

*Primary Examiner*—David A. Okonsky
*Attorney, Agent, or Firm*—Michael I. Kroll

[57] ABSTRACT

A tangential driven rotary engine (10) comprising an engine block (12) having a plurality of cylinder combustion chambers (14) radially positioned therein. A plurality of pistons (16) are each movable and disposed within each cylinder combustion chamber (14) in the engine block (12). A plurality of spark plugs (18) are each radially positioned on the engine block (12) to extend into one cylinder combustion chamber (14). A plurality of intake valves (20) are each radially positioned on the engine block (12) to extend into one cylinder combustion chamber (14). A plurality of exhaust valves (22) are each radially positioned on the engine block (12) to extend into one cylinder combustion chamber (14). A main motor shaft (24) extends centrally through the engine block (12) with the cylinder combustion chambers (14) and the pistons (16) radially positioned thereabout. A facility (26) is for changing the reciprocating motion of the pistons (16) into a rotary motion for the main motor shaft (24). A component 28 on the main motor shaft (24) is for operating each of the spark plugs (18), each of the intake valves (20) and each of the exhaust valves (22) in timed intervals.

14 Claims, 5 Drawing Sheets

28
56
58
24
68
18
66
22
10
64
20
12
16
44
26
46
50
52
54
30
34
48

TANGENTIAL DRIVEN ROTARY ENGINE

BACKGROUND OF THE INVENTION

1. Field of the Invention

The instant invention relates generally to internal combustion engines and more specifically it relates to a tangential driven rotary engine. The tangential driven rotary engine combines the best features of a piston engine with the best features of a rotary engine, so as to better operate a motor vehicle.

The first successful rotary engine was developed in 1956 by Felix Wankel of West Germany. The pistons are replaced by a three-cornered rotor that turns in an oval housing, providing three separate combustion chambers. The engine is lighter than a comparable piston engine, but difficulties with rotating seals are possible, fuel efficiency is poorer, and pollution problems are more likely.

2. Description of the Prior Art

Numerous internal combustion engines have been provided in prior art that are adapted to burn fuel within enclosed spaces to move pistons in cylinders and turn crankshafts, so as to operate motor vehicles which will travel along roads. While these units may be suitable for the particular purpose to which they address, they would not be as suitable for the purposes of the present invention as heretofore described.

SUMMARY OF THE INVENTION

A primary object of the present invention is to provide a tangential driven rotary engine that will overcome the shortcomings of the prior art devices.

Another object is to provide a tangential driven rotary engine that has less movable parts with less friction loss, so consequently the engine is more efficient, in which it produces increased revolutions per minute and additional horsepower.

An additional object is to provide a tangential driven rotary engine that is more compact, so it weighs less than a conventional engine, and it can be turned up more quickly since there is no chain or belt to adjust, allowing a more accurate timing to increase its efficiency.

A further object is to provide a tangential driven rotary engine that is simple and easy to use.

A still further object is to provide a tangential driven rotary engine that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
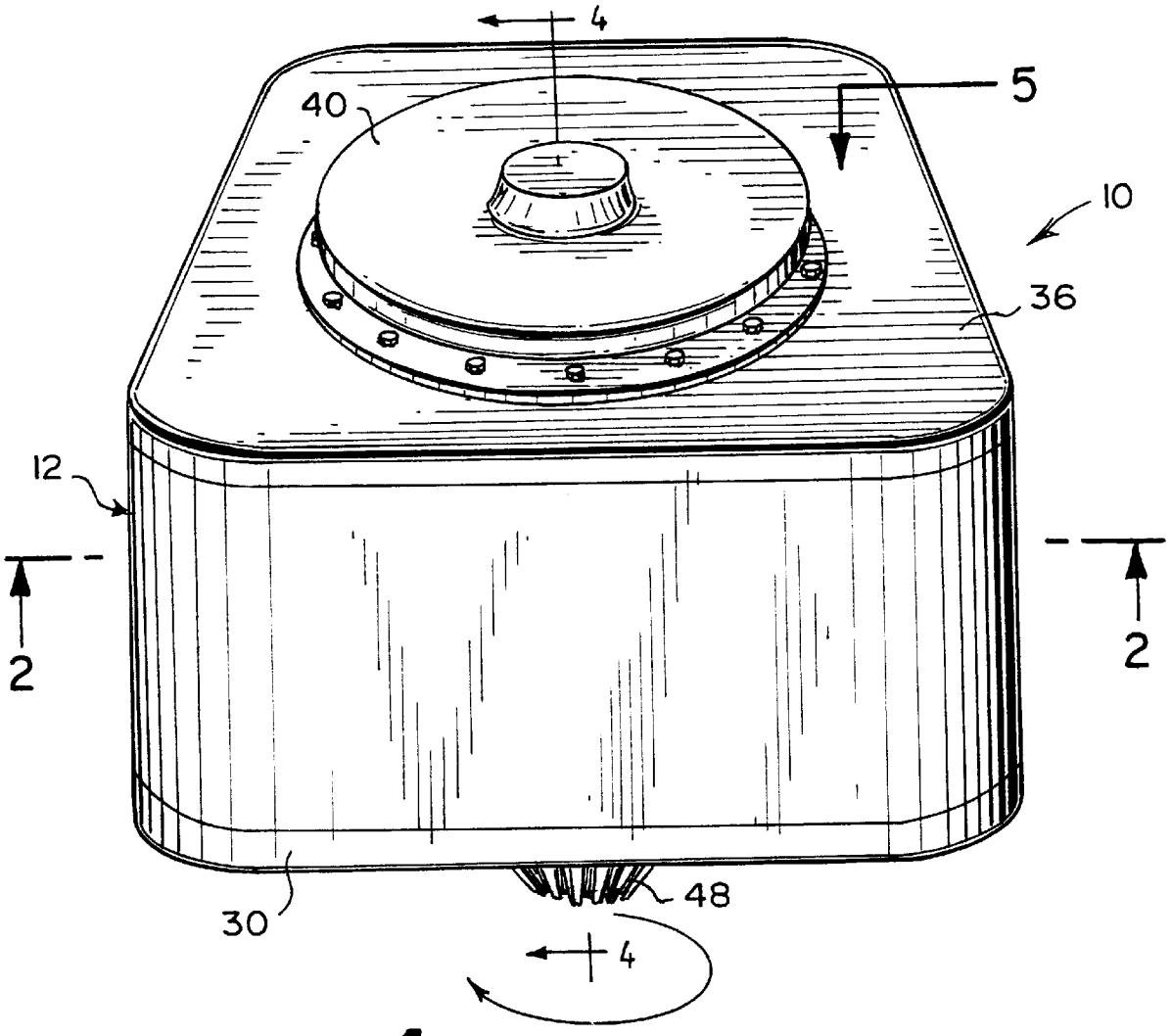
FIG. 1 is a top perspective view of the instant invention assembled.
Figure 2:
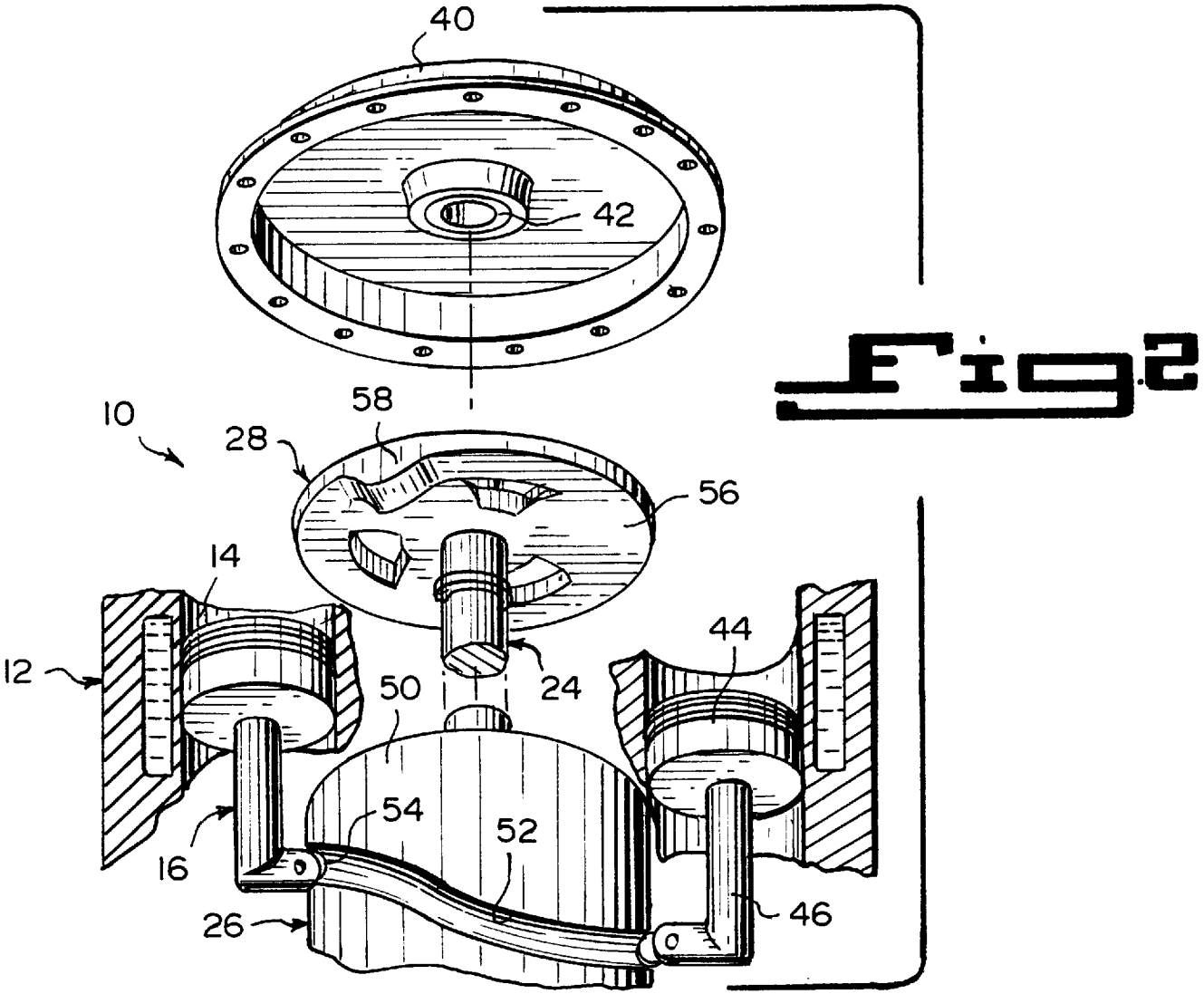
FIG. 2 is a partial bottom perspective cross sectional view with parts broken away, taken along line 2—2 in FIG. 1.
Figure 3:
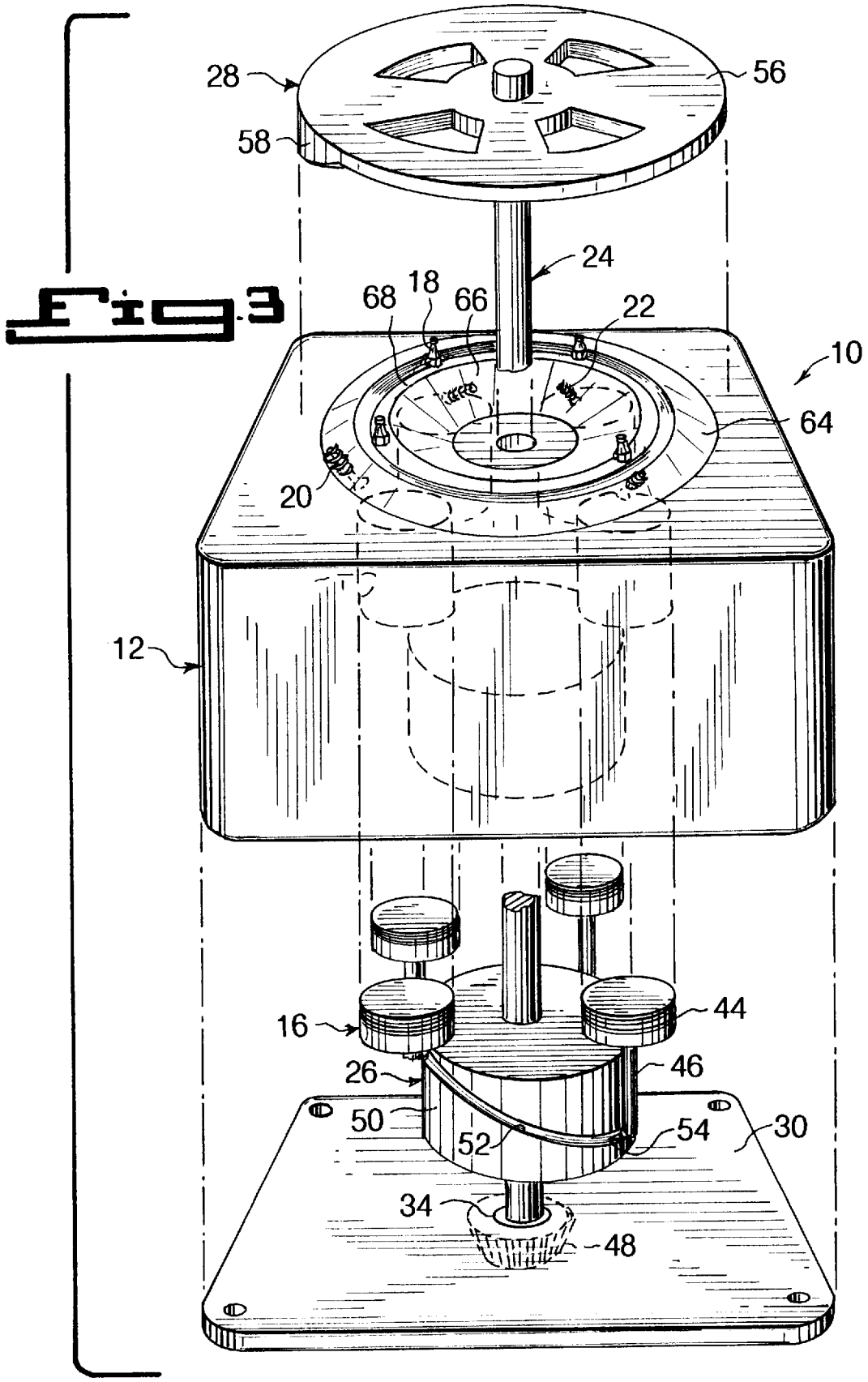
FIG. 3 is a top perspective view of the instant invention with parts removed, exploded and broken away.
Figure 4:
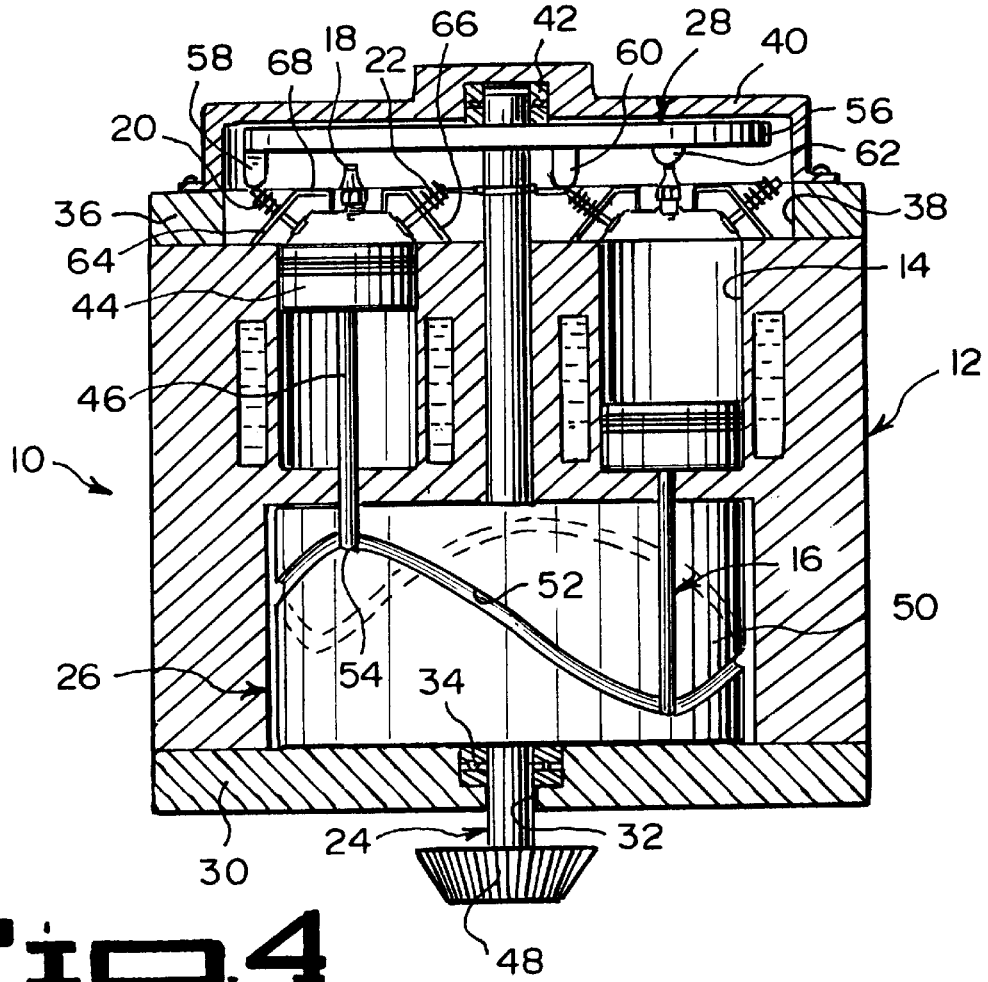
FIG. 4 is a cross sectional view taken along line 4—4 in FIG. 1.
Figure 5:
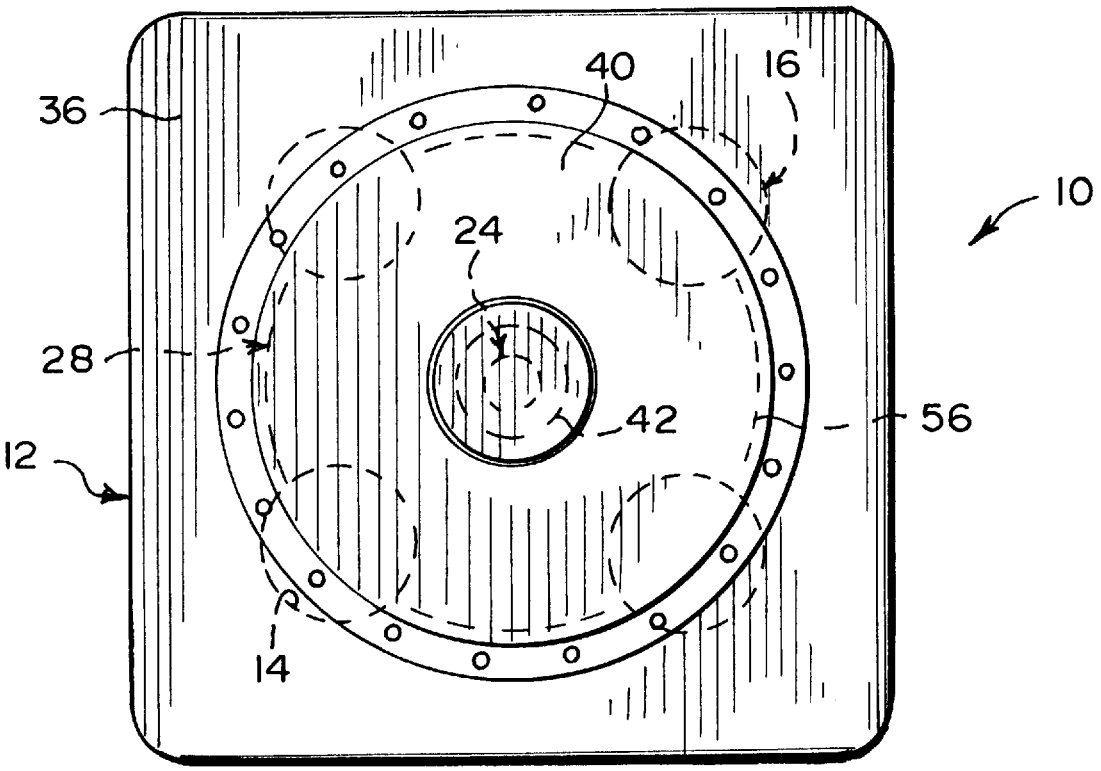
FIG. 5 is a top view taken in the direction of arrow 5 in FIG. 1.

Turning now descriptively to the drawings, in which similar reference characters denote similar elements throughout the several views, FIGS. 1 to 5 illustrate a tangential driven rotary engine 10 comprising an engine block 12 having a plurality of cylinder combustion chambers 14 radially positioned therein. A plurality of pistons 16 are each movable and disposed within each cylinder combustion chamber 14 in the engine block 12. A plurality of spark plugs 18 are each radially positioned on the engine block 12, to extend into one cylinder combustion chamber 14. A plurality of intake valves 20 are each radially positioned on the engine block 12, to extend into one cylinder combustion chamber 14. A plurality of exhaust valves 22 are each radially positioned on the engine block 12, to extend into one cylinder combustion chamber 14.

A main motor shaft 24 extends centrally through the engine block 12 with the cylinder combustion chamber 14 and the pistons 16 radially positioned thereabout. A facility 26 is for changing the reciprocating motion of the pistons 16 into a rotary motion for the main motor shaft 24. A component 28 on the main motor shaft 24 is for operating each of the spark plugs 18, each of the intake valves 20 and each of the exhaust valves 22 in timed intervals.

The engine block 12 includes a bottom cover 30 having a central aperture 32 therethrough. A bottom bearing 34 is located at the central aperture 32 in the bottom cover 30, for the main motor shaft 24 to extend through. A top cover 36 has a large central opening 38 therethrough. A cap 40 is affixed to the top cover 36 over the large central opening 38, so as to enclose the spark plugs 28, the intake valves 20, the exhaust valves 22 and the operating component 28 therein. A top bearing 42 is located centrally with the cap 40, for the main motor shaft 24 to rotatively engage with.

Each piston 16 consists of a piston head 44 and a stud 46 affixed to and extending downwardly from the piston head 44. A bevel gear 48 on a bottom end of the main motor shaft 24 extends outwardly from a bottom end of the engine block 12. The bevel gear 48 can engage with another bevel gear on a horizontal drive shaft (not shown).

The motion changing facility 26 comprises the main motor shaft 24 having an enlarged cylindrical member 50 with a sinuous curved track 52 thereon. Each piston stud 46 has a bearing roller 54 on a distal lower end, which rides within the sinuous curved track 52 in the enlarged cylindrical member 50 on the main motor shaft 24. When the pistons 16 move up and down during operation thereof, the bearing rollers 54 in the sinuous curved track 52 will cause the enlarged cylindrical member 50 to rotate the main motor shaft 24 within the engine block 12.

The operating component 28 consists of a disc member 56 affixed centrally to a top end of the main motor shaft 24. A first cam 58 on the disc member 56 depresses each intake valve 20 in the timed intervals, when the disc member 56 rotates with the main motor shaft 24. A second cam 60 on the disc member 56 depresses each exhaust valve 22 in the timed intervals, when the disc member 56 rotates with the main motor shaft 24. An electric contact 62 on the disc member 56 engages each spark plug 18 in the timed intervals, when the disc member 56 rotates with the main motor shaft 24.

An outer torus member 64 is on the engine block 12 within the large central opening 38 in the top cover 36. All of the intake valves 20 are mounted in the outer torus member 64. An inner torus member 66 is on the engine block 12 within the large central opening 38 in the top cover 36. All of the exhaust valves 22 are mounted in the inner torus member 66. A ring member 68 is on the engine block 12 between the outer torus member 64 and the inner torus member 66 on the engine block 12, within the large central opening 38 in the top cover 36. All of the spark plugs 18 are mounted in the ring member 68.

The sinuous curved track 52 is in a continuous serpentine pattern about the enlarged cylindrical member 50 on the main motor shaft 24. The continuous serpentine pattern has a plurality of peaks and a plurality of valleys, wherein each peak follows a valley in sequence thereabout. The carburetor, lubrication, cooling and starting systems are not shown in the drawings, since they are all conventional. The enlarged cylindrical member 50 can be hollow with the sinuous curved track 52 placed on the inside. The pistons 16 can now be radially arrange closer to the main motor shaft 24 within the engine block 12.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letter Patent is set forth in the appended claims:

1. A tangential driven rotary engine comprising:

a) an engine block having a plurality of cylinder combustion chambers radially positioned therein;

b) a plurality of pistons, each movable and disposed within each said cylinder combustion chamber in said engine block;

c) a plurality of spark plugs, each radially positioned on said engine block to extend into one cylinder combustion chamber;

d) a plurality of intake valves, each radially positioned on said engine block to extend into one cylinder combustion chamber;

e) a plurality of exhaust valves, each radially positioned on said engine block to extend into one said cylinder combustion chamber;

f) a main motor shaft extending centrally through said engine block with said cylinder combustion chambers and said pistons radially positioned thereabout;

g) means for changing the reciprocating motion of said pistons into a rotary motion for said main motor shaft; and h) means on said main motor shaft for operating each of said spark plugs, each of said intake valves and each of said exhaust valves in timed intervals, wherein said engine block includes:

i) a bottom cover having a central aperture therethrough;

ii) a bottom bearing located at said central aperture in said bottom cover for said main motor shaft to extend through;

iii) a top cover having a large central opening therethrough;

iv) a cap affixed to said top cover over said large central opening so as to enclose said spark plugs, said intake valves, said exhaust valves and said operating means therein; and v) a top bearing located centrally with said cap for said main motor shaft to rotatively engage with, and said tangential driven rotary engine further includes an outer torus member on said engine block within said large central opening in said top cover, in which all of said intake valves are mounted in said outer torus member.

2. A tangential driven rotary engine as recited in claim 1, wherein each said piston includes:

a) a piston head; and b) a stud affixed to and extending downwardly from said piston head.

3. A tangential driven rotary engine as recited in claim 1, further comprising a bevel gear on a bottom end of said main motor shaft extending outwardly from a bottom end of said engine block, so that said bevel gear can engage with another bevel gear on a horizontal drive shaft.

4. A tangential driven rotary engine as recited in claim 1, wherein said motion changing means includes:

a) said main motor shaft having an enlarged cylindrical member with a sinuous curved track thereon; and b) each said piston stud having a bearing roller on a distal lower end, which rides within said sinuous curved track in said enlarged cylindrical member on said main motor shaft, so that when said pistons move up and down during operation thereof, said bearing rollers in said sinuous curved track will cause said enlarged cylindrical member to rotate said main motor shaft within said engine block.

5. A tangential driven rotary engine as recited in claim 4, wherein said sinuous curved track is in a continuous serpentine pattern about said enlarged cylindrical member on said main motor shaft, wherein said continuous serpentine pattern has a plurality of peaks and a plurality of valleys, wherein each said peak follows a valley in sequence thereabout.

6. A tangential driven rotary engine as recited in claim 1, wherein said operating means includes:

a) a disc member affixed centrally to a top end of said main motor shaft;

b) a first cam on said disc member to depress each said intake valve in the timed intervals, when said disc member rotates with said main motor shaft;

c) a second cam on said disc member to depress each said exhaust valve n the timed intervals, when said disc member rotates with said main motor shaft; and d) an electric contact on said disc member to engage each said spark plug in the timed intervals, when said disc member rotates with said main motor shaft.

7. A tangential driven rotary engine as recited in claim 1, further including an inner torus member on said engine block within said large central opening in said top cover, in which all of said exhaust valves are mounted in said inner torus member.

8. A tangential driven rotary engine as recited in claim 7, further including a ring member on said engine block between said outer torus member and said inner torus member on said engine block within said large central opening in said top cover, in which all of said spark plugs are mounted in said ring member.

9. A tangential driven rotary engine as recited in claim 1, further comprising a bevel gear on a bottom end of said main motor shaft extending outwardly from a bottom end of said engine block, so that said bevel gear can engage with another bevel gear on a horizontal drive shaft.

10. A tangential driven rotary engine as recited in claim 9, wherein said motion changing means includes:

a) said main motor shaft having an enlarged cylindrical member with a sinuous curved track thereon; and b) each said piston stud having a bearing roller on a distal lower end, which rides within said sinuous curved track in said enlarged cylindrical member on said main motor shaft, so that when said pistons move up and down during operation thereof, said bearing rollers in said sinuous curved track will cause said enlarged cylindrical member to rotate said main motor shaft within said engine block.

11. A tangential driven rotary engine as recited in claim 10, wherein said operating means includes:

a) a disc member affixed centrally to a top end of said main motor shaft;

b) a first cam on said disc member to depress each said intake valve in the timed intervals, when said disc member rotates with said main motor shaft;

c) a second cam on said disc member to depress each said exhaust valve n the timed intervals, when said disc member rotates with said main motor shaft; and d) an electric contact on said disc member to engage each said spark plug in the timed intervals, when said disc member rotates with said main motor shaft.

12. A tangential driven rotary engine as recited in claim 11, further including an inner torus member on said engine block within said large central opening in said top cover, in which all of said exhaust valves are mounted in said inner torus member.

13. A tangential driven rotary engine as recited in claim 12, further including a ring member on said engine block between said outer torus member and said inner torus member on said engine block within said large central opening in said top cover, in which all of said spark plugs are mounted in said ring member.

14. A tangential driven rotary engine as recited in claim 13, wherein said sinuous curved track is in a continuous serpentine pattern about said enlarged cylindrical member on said main motor shaft, wherein said continuous serpentine pattern has a plurality of peaks and a plurality of valleys, wherein each said peak follows a valley in sequence thereabout.

* * * * *